US006135867A

United States Patent [19]

Yeagle et al.

[11] Patent Number: 6,135,867

[45] Date of Patent: Oct. 24, 2000

[54] APPARATUS AND METHOD FOR GLASS BALL LENS POLISHING

[75] Inventors: Frederick A. Yeagle, Leesport; Brian D. Potteiger, Reading; Faisal A. Nabulsi, Allentown, all of Pa.

[73] Assignee: Lucent Technologies Inc., Murray Hill, N.J.

[21] Appl. No.: 09/349,006

[22] Filed: Jul. 7, 1999

[51] Int. Cl.[7] ..... B24B 41/06

[52] U.S. Cl. ..... 451/364; 451/384; 451/42

[58] Field of Search ..... 451/364, 368, 451/379, 384, 385, 390, 365, 42, 43, 50; 206/485, 589, 588, 590; 269/268

[56] References Cited

U.S. PATENT DOCUMENTS

| | | | |
|---|---|---|---|
| 1,516,749 | 11/1924 | Moore et al. | 451/50 |
| 4,856,234 | 8/1989 | Goins | 51/284 R |
| 4,965,967 | 10/1990 | London | 51/289 S |
| 5,066,090 | 11/1991 | Mayerhofer et al. | 385/35 |
| 5,520,573 | 5/1996 | Sumita et al. | 451/262 |
| 5,720,390 | 2/1998 | Bostelman | 206/587 |
| 5,842,568 | 12/1998 | Chang-wen et al. | 206/419 |
| 5,913,717 | 6/1999 | Tonooka et al. | 451/282 |

*Primary Examiner*—Timothy V. Eley
*Assistant Examiner*—Dung Van Nguyen
*Attorney, Agent, or Firm*—Duane Morris & Heckscher LLP

[57] ABSTRACT

An apparatus and method for polishing a rotationally symmetric object such as a glass ball lens. The apparatus includes first and second plates for securing a plurality of glass ball lenses therebetween. The plates are secured to one another and the entire apparatus is pressed against a polishing pad in order to flatten a portion of the surface of the lenses. The apparatus also serves to maintain the orientation of the rotationally symmetric objects, so that they may be easily operated upon by future processing steps.

20 Claims, 7 Drawing Sheets

APPARATUS AND METHOD FOR GLASS BALL LENS POLISHING

FIELD OF THE INVENTION

The present invention relates an apparatus and method for polishing a rotationally symmetric object, and in particular, a method and apparatus for polishing a glass ball lens.

DESCRIPTION OF THE RELATED ART

Glass ball lenses are used in a wide variety of applications. For example, optical subassemblies (OSAs) utilize glass ball lenses to collimate laser beams. OSAs are most typically used in telecommunications equipment, such as fiber-optic devices. Most of the applications for glass ball lenses require a surface of the lens to be polished flat for various mechanical and/or optical reasons. For example, polishing a surface of the lens flat allows it to be more easily placed on a substrate. Thus, various techniques have been developed to polish the surface of glass ball lenses.

One such technique involves using a paraffin medium (e.g. wax) to hold a plurality of glass balls during the polishing process. The balls are placed in a carrier containing the paraffin, and then the carrier is pressed against a rotating polishing wheel to polish the surfaces of the lenses. Once the polishing is complete, the glass ball lenses are removed from the paraffin medium by hand and cleaned in a chemical bath. The lenses must then be oriented by hand on another carrier for transportation to another manufacturing step, or shipment to customers. It is important that the lenses have the same orientation in the carrier, as it allows them to be operated upon by automated processes in the future. If the lenses all have different orientations, it will be difficult, if not impossible for an automated device, such as a 'pick and place' machine, to accurately transport the lenses.

The major drawbacks of the polishing process described above are that the paraffin must be removed, and the lenses must be oriented on a carrier by hand, both adding extra time and expense to the process. Thus, there currently exists a need for a glass ball lens polishing technique which is speedy and efficient, and which maintains the orientation of the lenses throughout the polishing.

SUMMARY OF THE INVENTION

The present invention is a method and apparatus for polishing rotationally symmetric objects, for example glass ball lenses. The invention includes first and second plates which hold at least one rotationally symmetric object therebetween. A portion of the rotationally symmetric object extends through one or both of the plates so that when the structure containing the object is brought into contact with a polishing device, the portion of the rotationally symmetric object can be polished. The apparatus also maintains the orientation of the rotationally symmetric objects, so that the objects can be operated upon by additional automated processes.

The above and other advantages and features of the present invention will be better understood from the following detailed description of the preferred embodiments of the invention which is provided in connection with the accompanying drawings.

DETAILED DESCRIPTION

Figure 1:
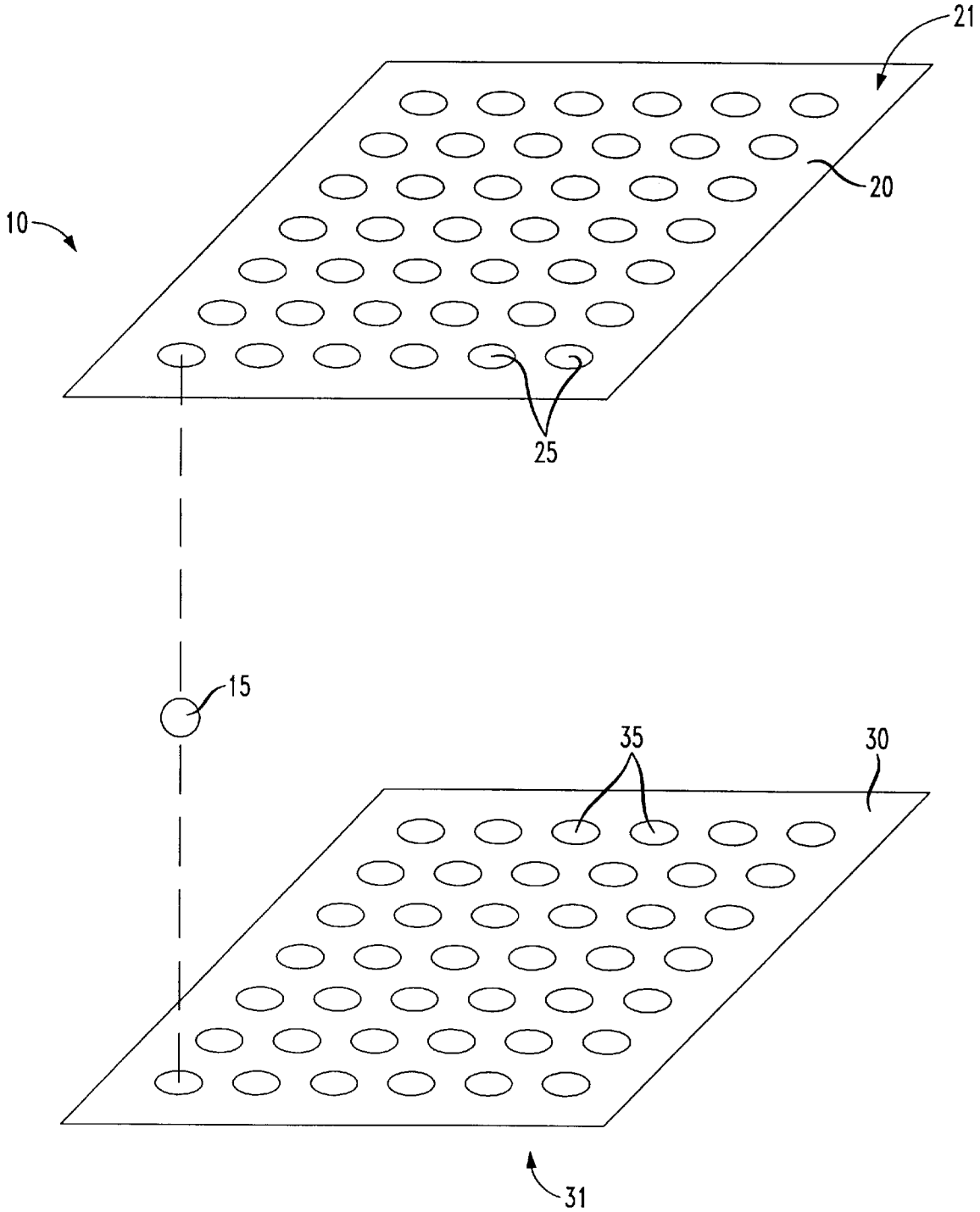
FIG. 1 is an exploded isometric view of an apparatus according to a first embodiment of the present invention.

Referring to FIG. 1, there is shown an apparatus 10 for holding rotationally symmetric objects 15, such as glass ball lenses. Typically, the rotationally symmetric objects 15 are spherical glass ball lenses, however, the apparatus may be utilized for polishing any object which is rotationally symmetric (e.g. spheres, ellipsoids, egg-shapes). The apparatus 10 operates to hold the rotationally symmetric objects 15 firmly during a polishing process, and to maintain the orientation of the objects for further processing steps. The apparatus includes first 20 and second 30 plates. The plates 20, 30 each have a plurality of holes 25, 35 respectively formed therein. In order to hold the same number of rotationally symmetric objects 15, plates 20, 30 should both have the same number of holes 25, 35 formed therein. Additionally, the holes 25 in plate 20 should correspond in position to the holes 35 formed in plate 30 so that the rotationally symmetric objects 15 fit therebetween. When the rotationally symmetric objects 15 are spherical objects, the diameter of the holes 25, 35 may be made slightly less than the diameter of the rotationally symmetric objects 15 which are to be held. When the rotationally symmetric objects 15 are, for example, ellipsoids and egg-shapes, the diameter of the holes are made slightly less than the diameter of a portion of the ellipsoid or egg-shape (since ellipsoids and egg-shapes vary in diameter throughout). Thus, when the rotationally symmetric object 15 is placed between the two plates 20, 30 portions 16, 17 thereof extend beyond the outer faces 21, 31 of the plates (see FIG. 2). Smaller holes may alternatively be used; this results in portions 16 and 17 extending a shorter distance beyond the outer faces 21, 31. Further, if only one side of the objects 15 is to be polished, then it is not necessary for both sides of the objects to extend the same distance beyond faces 21, 31. Thus, smaller hole sizes in plate 20, for example, do not need to be the same as those in plate 30.

Figure 3:
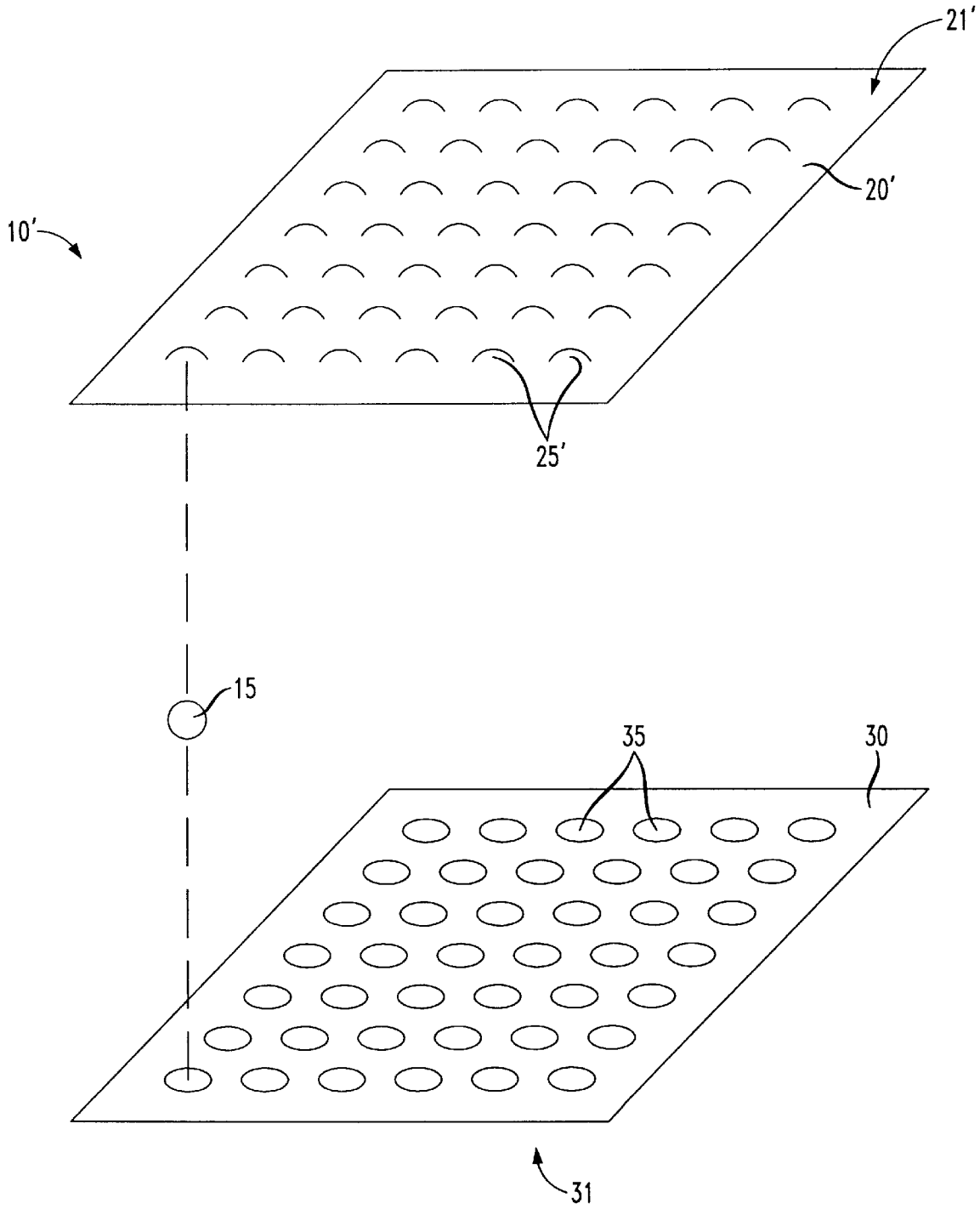
FIG. 3 is an exploded isometric view of an apparatus according to a second embodiment of the present invention.
Figure 4:
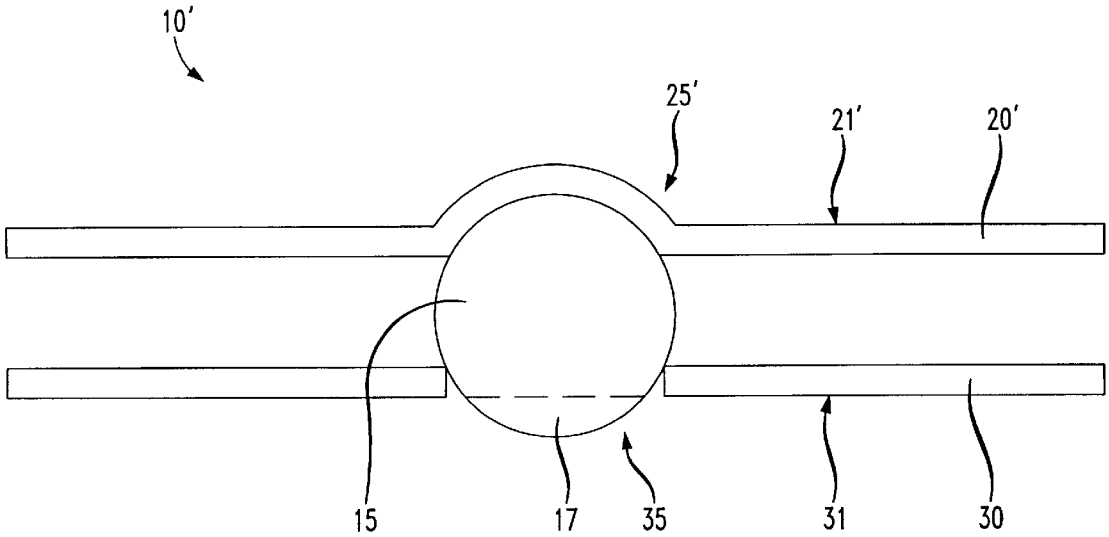
FIG. 4 is a cross-sectional view of the apparatus shown in FIG. 3.

Furthermore, there need not be any holes in the plate 20, 30 corresponding to a side of the object 15 which is not polished. FIGS. 3 and 4 show a second embodiment of the apparatus, designated as 10', where the plate 20', for example, includes a plurality of indentations 25' formed therein for grasping a surface of the rotationally symmetric objects 15. In the second embodiment, it is assumed that only the portion 17 of the object 15 which extends beyond face 31 of plate 30 is to be polished. Additionally, although in the exemplary embodiment the indentations 25' are formed as a portion of a sphere, they may be formed to conform to the shape of whatever rotationally symmetric object 15 is being polished.

Figure 2:
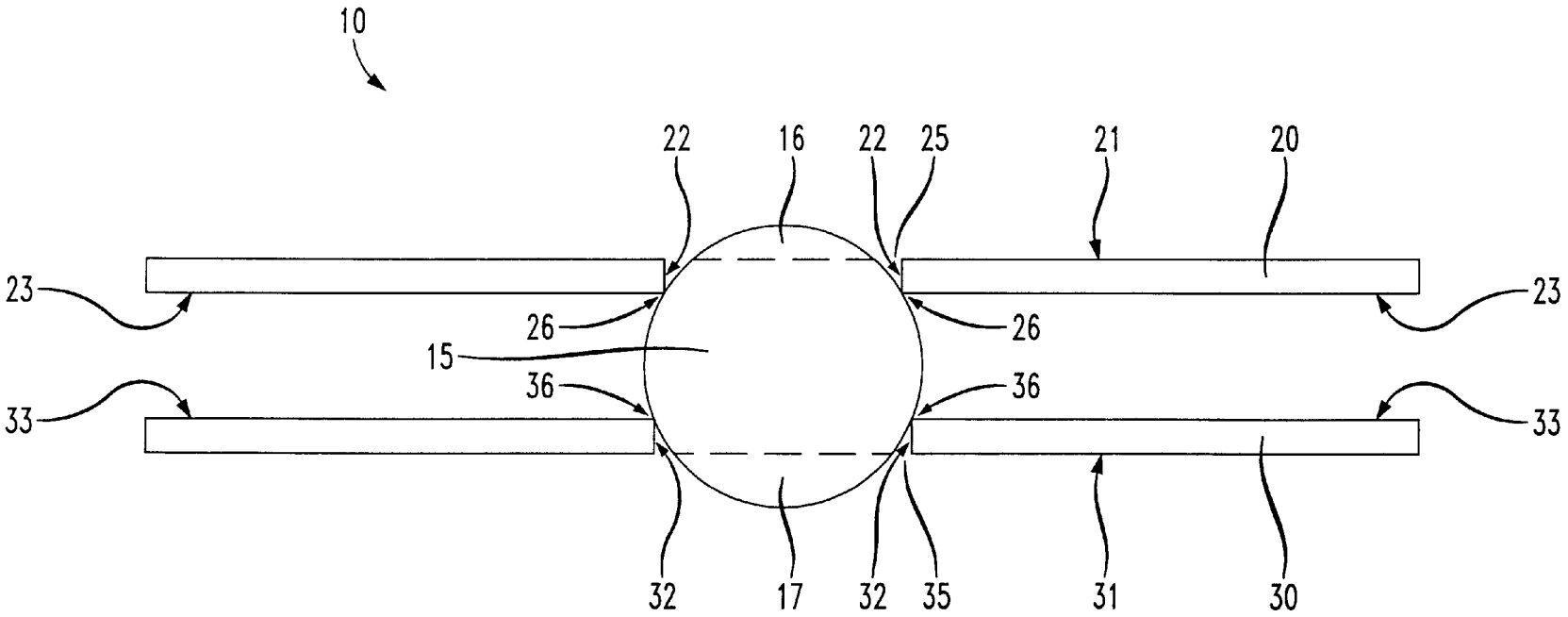
FIG. 2 is a cross-sectional view of the apparatus shown in FIG. 1.
Figure 5:
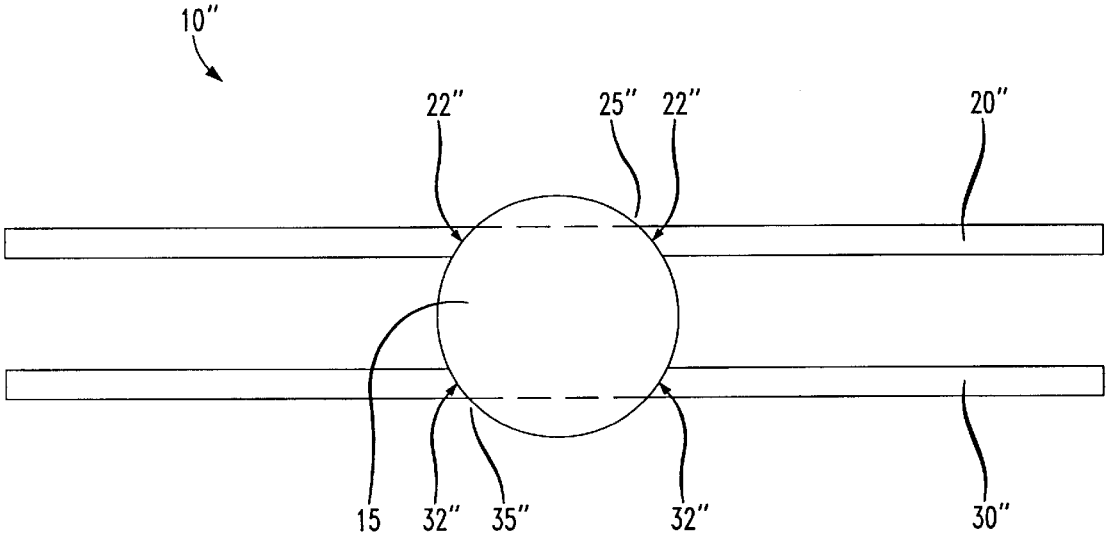
FIG. 5 is cross-sectional view showing an apparatus according to a third embodiment of the present invention.

FIG. 2 is a cross-sectional view of a portion of the apparatus 10 showing one of the rotationally symmetric objects 15 held between first and second plates 20, 30. The sidewalls 22, 32 of the plates 20, 30 are substantially orthogonal to the outer 21, 31 and inner 23, 33 faces of the plates 20, 30. Therefore, only two corners 26, 36 of each of the plates 20, 30 contact each rotationally symmetric object 15. However, the sidewalls 22, 32 may be configured in many other ways known to those skilled in the art. For example, FIG. 5 shows a third embodiment of the apparatus, designated as 10", where the sidewalls 22", 32" of the holes 25", 35" in the plates 20", 30" are curved so as to conform to the shape of the rotationally symmetric objects 15. The curved sidewalls 22", 32" may also be textured to prevent rotation of the rotationally symmetric objects 15.

Figure 6:
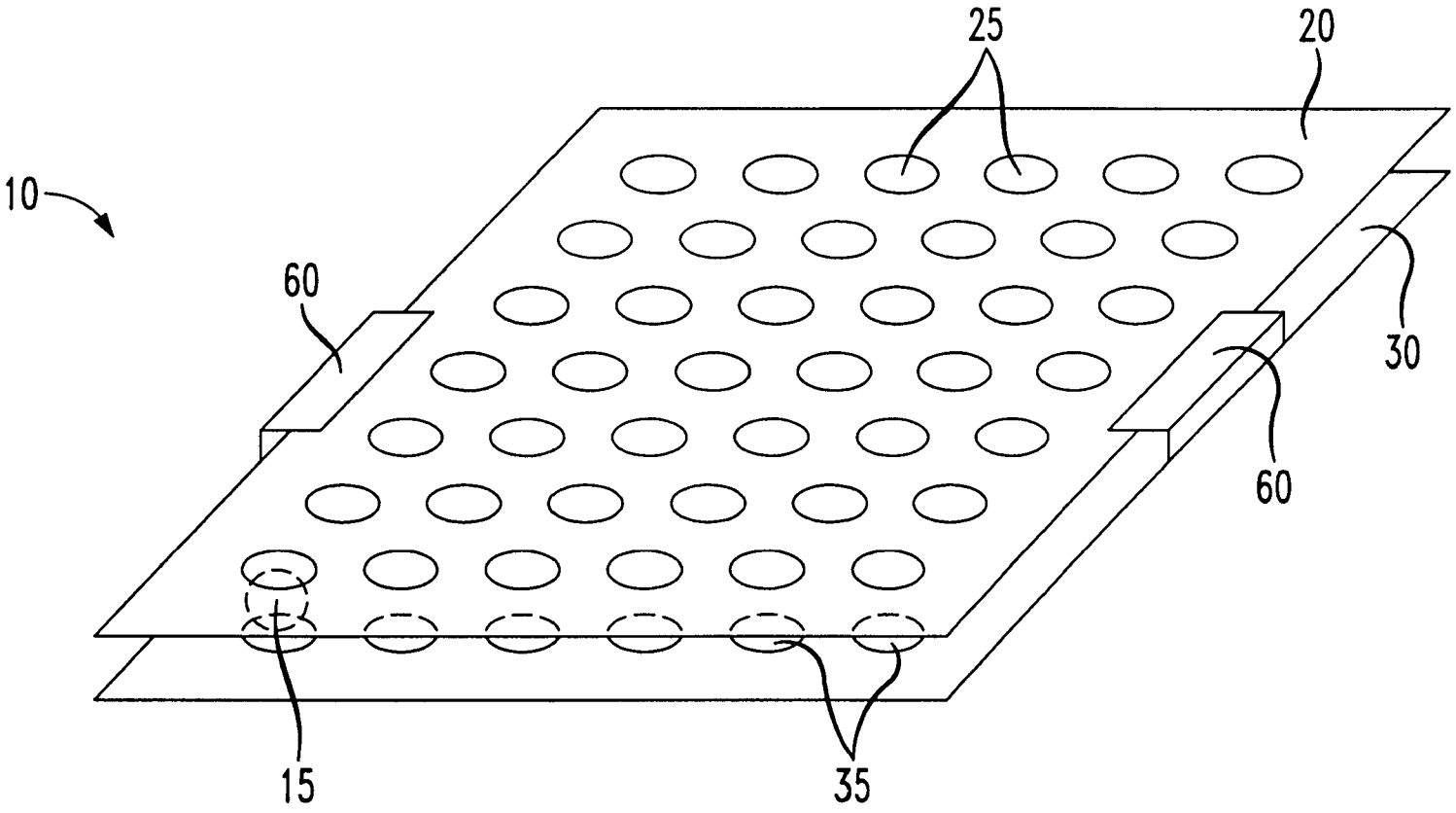
FIG. 6 is an isometric view of the first embodiment showing the apparatus assembled.

The apparatus 10 (10', 10") according to the first through third embodiments, may be held together with a clamp or other securing means 60. FIG. 6 shows the apparatus 10 (10', 10") fully assembled with clamps 60 holding the plates 20, 30 (20', 30',20", 30") tightly together. In the exemplary embodiment, the clamps 60 are, for instance, deformable metal clamps. However, any number of clamping or securing means can be used to hold the plates 20, 30 (20', 30',20", 30") together without departing from the scope of the invention.

In both of the above-described embodiments, the plates 20, 30 (20', 30', 20", 30") and the clamps 60 are preferably made of metal, however, they may be made of any suitable material without departing from the scope of the present invention. Further, although the first and second embodiments are described as utilizing plates 20, 30 (20', 30', 20", 30") with a plurality of holes 25, 35 (25", 35") or indentations 25', it should be noted that the plates may include only one hole or indentation, or any particular number of holes or indentations.

Figure 7:
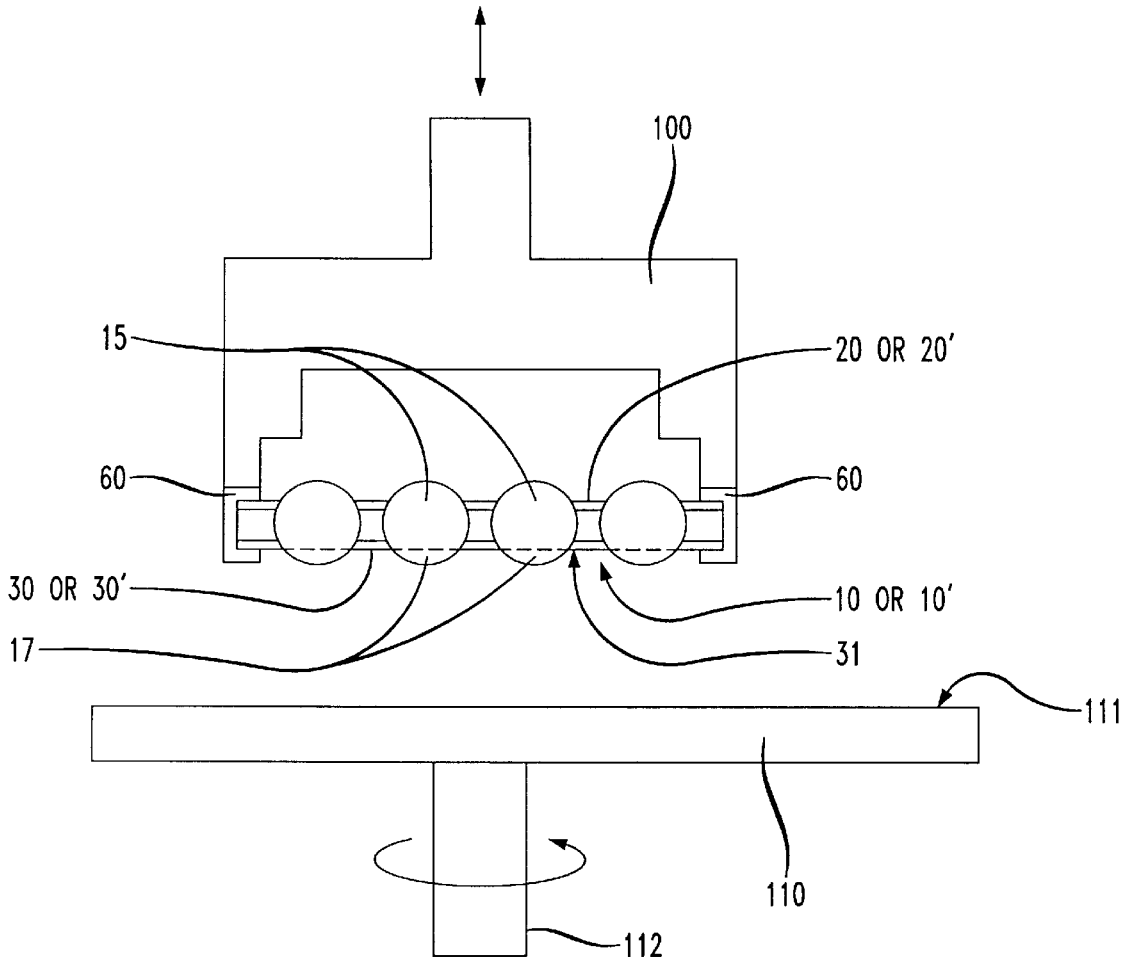
FIG. 7 shows the present invention utilized in a polishing process with a first driving mechanism.

FIG. 7 shows the apparatus 10 (10', 10") of the present invention used in a polishing process. The assembled and clamped apparatus 10 (10', 10") is attached to a driver mechanism 100, by fasteners (e.g. screws) or other means (not shown), which moves the apparatus 10 (10', 10") in the vertical direction. Although it may appear in the figure as though the clamp 60 interferes with the polishing process, in reality this is not the case. Clamp 60 is not drawn in scale in the figure. The clamp 60 is actually made sufficiently thin so as to not interfere substantially with the polishing of portion 17 of the rotationally symmetric objects 15. The clamped apparatus 10 (10', 10") is lowered by the driver mechanism 100 onto a polishing pad 110 which has an abrasive surface 111. The abrasive surface 111 may be, for example, diamond impregnated nickel. The polishing pad 110 rotates about a shaft 112 to which it is attached. As the apparatus 10 (10', 10") is lowered against the rotating polishing pad 110, the portion 17 of the rotationally symmetric object 15 which protrudes beyond the outer face 31 of plate 30 (and clip 60) comes into contact with the polishing pad. The abrasive surface 111 of the polishing pad 110 causes the portion 17 to wear away and become flattened, as exemplified by the dashed line. Portion 17 should not be polished all the way to the clamp 60 and plate 30, because such a procedure would cause damage to those elements. When the portion 17 becomes sufficiently flattened, the driver mechanism 100 withdraws the apparatus from the polishing pad 110, and the apparatus 10 (10', 10") is removed from the driver mechanism.

Figure 8:
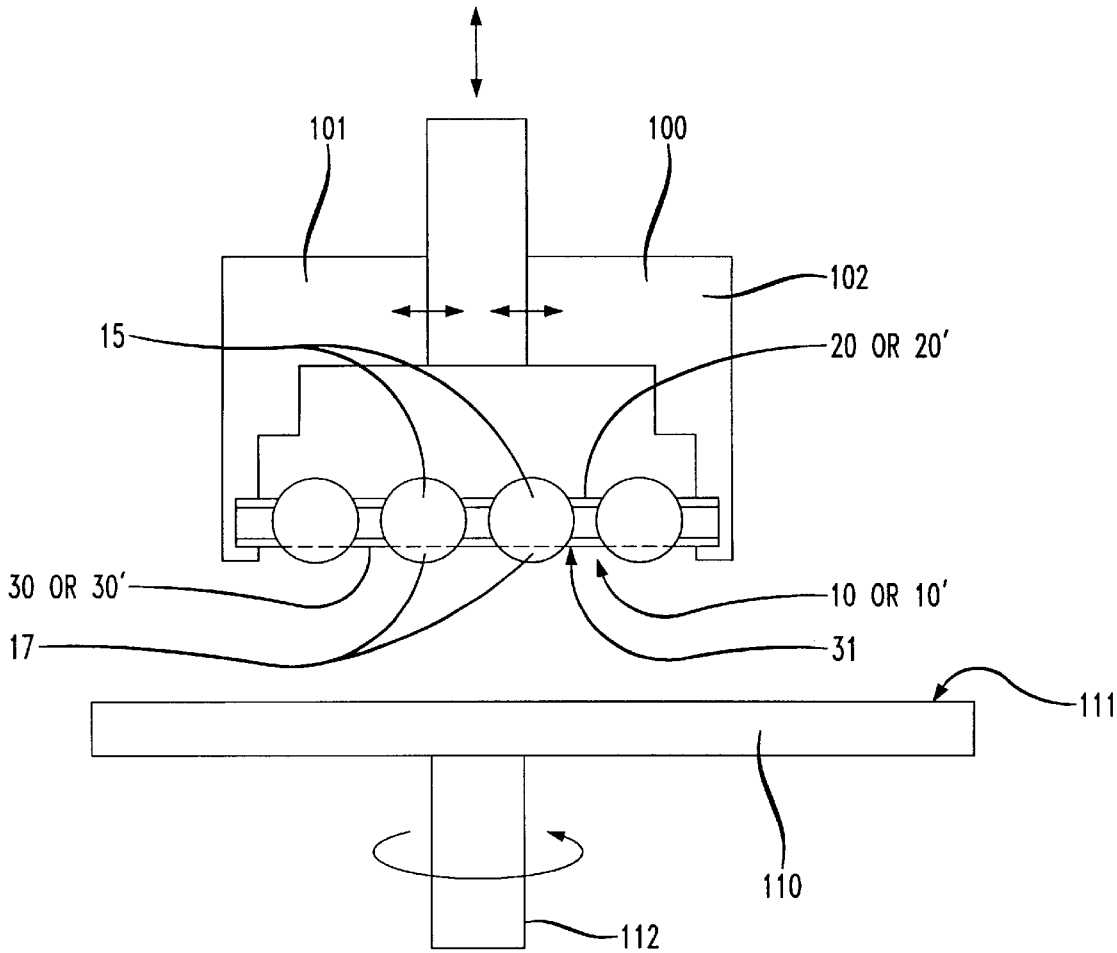
FIG. 8 shows the present invention utilized in a polishing process with a second driving mechanism.

FIG. 8 shows an alternate embodiment of the driver mechanism 100', where the driver mechanism grasps the apparatus 10 (10', 10") from the sides, thereby eliminating the need for clamps 60. The driver mechanism 100' includes movable arms 101, 102 which are movable in the horizontal direction. After the apparatus 10 (10', 10") is placed between the arms 101, 102, the arms are moved together to grasp the apparatus therebetween. The force of the arms against the sidewalls of the plates 20, 30 (20', 30', 20", 30") is sufficient to hold the plates steady while the apparatus 10 (10', 10") is applied against the polishing pad 110. It should be understood that FIGS. 7 and 8 show only two possible methods of grasping the apparatus 10 (10', 10"), and that there are many other possible ways to grasp the apparatus without departing from the scope of the invention.

When the apparatus 10 (10', 10") is removed from the driver mechanism 100 (100'), all the rotationally symmetric objects 15 are oriented in the same manner (i.e., all the flattened surface are facing down). From this point the apparatus 10 (10', 10") may be transferred to another processing station for additional manufacturing steps, for example placing of the objects on a substrate. For this type of manufacturing step, an automated device, such as a 'pick and place' machine would typically be utilized. Since the rotationally symmetric objects all have the same orientation, the 'pick and place' machine can easily remove them from the apparatus 10 (10', 10") and transfer them to a substrate. Even if no additional manufacturing is required, the orientation of the rotationally symmetric objects within the apparatus 10 (10', 10") is beneficial. For example, if the rotationally symmetric objects 15 need to be placed into a carrier for shipment, they can be easily transferred to such a carrier by automated equipment.

Thus, utilizing the above apparatus and process, glass ball lenses can be easily and efficiently polished. More importantly, the present invention maintains the orientation of the glass ball lenses being polished, so that it is easier to transfer them to further automated manufacturing steps or package them for shipment to customers.

Although the invention has been described in terms of exemplary embodiments, it is not limited thereto. Rather, the appended claims should be construed broadly, to include other variants and embodiments of the invention which may be made by those skilled in the art without departing from the scope and range of equivalents of the invention.

What is claimed is:

1. An apparatus for securing at least one rotationally symmetric object during a polishing process comprising:

a first plate having at least one hole formed therein; and, a second plate having at least one hole formed therein, wherein the first and second plates grasp at least one rotationally symmetric object therebetween in the at least one hole of the first plate and the at least one hole of the second plate, and wherein a first portion of the rotationally symmetric object extends through the at least one hole formed in the first plate, and wherein edges of the first and second plates which contact the at least one rotationally symmetric object are curved.

2. The apparatus of claim 1, wherein a first portion of the rotationally symmetric object extends through the at least one hole formed in the first plate.

3. The apparatus of claim 2, wherein a second portion of the rotationally symmetric object extends through the at least one hole formed in the second plate.

4. An apparatus for securing at least one rotationally symmetric object during a polishing process comprising:

a first plate having at least one hole formed therein; and, a second plate having at least one hole formed therein, wherein the first and second plates grasp at least one rotationally symmetric object therebetween in the at least one hole of the first plate and the at least one hole of the second plate, and wherein the at least one rotationally symmetric object comprises a spherical glass ball lens.

5. The apparatus of claim 4, wherein the first plate has a plurality of holes formed therein.

6. The apparatus of claim 5, wherein the second plate has a plurality of holes formed therein.

7. The apparatus of claim 6, wherein the holes formed in the first plate correspond in number and position to the holes formed in the second plate.

8. The apparatus of claim 4, wherein the diameter of the at least one hole formed in the first plate is less than the diameter of the spherical object.

9. The apparatus of claim 4, further comprising at least one clamp for securing the rotationally symmetric object between the first and second plates.

10. The apparatus of claim 4, further comprising a polishing device for polishing a surface of the rotationally symmetric object.

11. The apparatus of claim 10, wherein a first portion of the rotationally symmetric object extends through the at least one hole formed in the first plate, said portion being polished by the polishing device.

12. The apparatus of claim 4, wherein edges of the first and second plates which contact the at least one spherical object are substantially flat.

13. The apparatus of claim 12, wherein the edges of the first and second plates are disposed at approximately a 90 degree angle with respect to upper and lower faces of the plates.

14. An apparatus for securing at least one rotationally symmetric object during a polishing process comprising:

a first plate having at least one hole formed therein; and, first body having at least one indentation formed therein, wherein the first plate and the first body grasp a rotationally symmetric object therebetween in the at least one hole and the at least one indentation, and wherein a first portion of the rotationally symmetric object extends through the at least one hole formed in the first plate, and wherein edges of the first and second plates which contact the at least one rotationally symmetric object are curved.

15. An apparatus for securing at least one rotationally symmetric object during a polishing process comprising:

a first plate having at least one hole formed therein; and, a first body having at least one indentation formed therein, wherein the first plate and the first body grasp a rotationally symmetric object therebetween in the at least one hole and the at least one indentation, and wherein the rotationally symmetric object comprises a spherical glass ball lens.

16. A method for polishing at least one rotationally symmetric object comprising the steps of:

placing the at least one rotationally symmetric object in a hole formed in a first plate so that a portion of the object extends through the plate;

placing a second plate overtop of the at least one rotationally symmetric object;

clamping the first and second plates together; and, polishing the portion of the at least one rotationally symmetric object which extends through the first plate with a polishing device.

17. A method for polishing at least one rotationally symmetric object comprising the steps of:

placing the at least one rotationally symmetric object in a hole formed in a first plate so that a portion of the object extends through the plate;

placing a second plate overtop of the at least one rotationally symmetric object;

clamping the first and second plates together; and, polishing the portion of the at least one rotationally symmetric object which extends through the first plate with a polishing device, wherein the at least one rotationally symmetric object comprises a spherical object.

18. The method of claim 17, wherein the at least one spherical object is a glass ball lens.

19. The method of claim 17, wherein the step of polishing the portion of the rotationally symmetric object with the polishing device comprises removing material from the portion with the polishing device until the portion becomes substantially flat.

20. The method of claim 17, wherein the diameter of the hole formed in the first plate is less than the diameter of the spherical object.

* * * * *